US007549365B2

(12) United States Patent
Root, Jr.

(10) Patent No.: US 7,549,365 B2
(45) Date of Patent: Jun. 23, 2009

(54) ELECTROMAGNETIC MISSILE LAUNCHER

(75) Inventor: George Raymond Root, Jr., Gambrills, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 181 days.

(21) Appl. No.: 10/899,234

(22) Filed: Jul. 26, 2004

(65) Prior Publication Data

US 2006/0011055 A1 Jan. 19, 2006

(51) Int. Cl.
*F41F 5/00* (2006.01)

(52) U.S. Cl. ..... 89/1.819; 89/1.8; 89/1.806; 89/8

(58) Field of Classification Search ..... 89/1.8, 89/1.806, 1.819, 8
See application file for complete search history.

(56) References Cited

U.S. PATENT DOCUMENTS

| | | | | | |
|---|---|---|---|---|---|
| 3,206,652 | A | * | 9/1965 | Monroe | 361/144 |
| 3,363,508 | A | * | 1/1968 | Bernhardt | 89/1.818 |
| 4,347,463 | A | * | 8/1982 | Kemeny et al. | 318/135 |
| 4,432,333 | A | * | 2/1984 | Kurherr | 124/3 |
| H000357 | H | * | 11/1987 | Howland et al. | 89/8 |
| 4,791,850 | A | | 12/1988 | Minovitch | |
| 4,922,800 | A | * | 5/1990 | Hoffman | 89/8 |
| 4,975,606 | A | * | 12/1990 | Wu et al. | 310/12 |
| 5,024,137 | A | * | 6/1991 | Schroeder | 89/8 |
| 5,168,118 | A | * | 12/1992 | Schroeder | 89/8 |
| 5,217,948 | A | * | 6/1993 | Leung et al. | 124/3 |
| 5,269,482 | A | * | 12/1993 | Shearing | 244/171.7 |
| 5,294,850 | A | * | 3/1994 | Weh et al. | 310/13 |
| 6,311,926 | B1 | * | 11/2001 | Powell et al. | 244/63 |
| 6,354,182 | B1 | * | 3/2002 | Milanovich | 89/1.818 |
| 6,361,393 | B1 | | 3/2002 | Seymour | |
| 6,696,775 | B2 | * | 2/2004 | Engel | 310/135 |

FOREIGN PATENT DOCUMENTS

| | | | |
|---|---|---|---|
| JP | 06-101994 | A | 4/1994 |
| JP | 11-183088 | A | 7/1999 |
| JP | 11-223493 | A | 8/1999 |
| JP | 2001-091193 | A | 4/2001 |

OTHER PUBLICATIONS

Not Translated, "Japan Patent Application No. 2006-522126 Office Action", Aug. 12, 2008, Publisher: JPO, Published in: JP.

* cited by examiner

*Primary Examiner*—Michelle Clement
(74) *Attorney, Agent, or Firm*—DeMont & Breyer LLC

(57) ABSTRACT

A technique for launching a missile that avoids some of the costs and disadvantages for doing so in the prior art. In particular, the illustrative embodiment of the present invention uses an electromagnetic catapult to throw the missile clear of the launch platform—with sufficient velocity to attain aerodynamic flight—before the missile's engine is ignited.

18 Claims, 10 Drawing Sheets

ELECTROMAGNETIC MISSILE LAUNCHER

FIELD OF THE INVENTION

The present invention relates to missilery in general, and, more particularly, to missile launchers.

BACKGROUND OF THE INVENTION

A missile is propelled by fuel and a chemical-propulsion engine. A chemical-propulsion engine propels a missile by the reaction that results from the rearward discharge of gases that are liberated when the fuel is burned. For the purposes of this specification, a "missile" is defined as a projectile whose trajectory is not necessarily ballistic and can be altered during flight (as by a target-seeking radar device and control elements).

When a missile is launched, the discharge of the hot gases causes several problems. First, the hot gases heat the launch platform, which renders the launch platform more visible to enemy infrared sensors and, therefore, more vulnerable to attack. Second, the hot gases can obscure the ability of personnel in the area of the launch platform to see, which might impair their ability to perform routine tasks, such as detecting enemy threats. Third, the brightness of the flame exiting the engine can—especially at night—temporarily blind the personnel in the area of the launch platform. Fourth, the missile's fuel often comprises an aluminized compound that is dispersed in the atmosphere surrounding the launch platform, which can impair the operation of radar systems near the launch platform. And fifth, as modern missiles become larger, their gases become hotter and more voluminous, and, therefore, cannot be adequately vented within the launching platform using current technology.

Therefore, the need exists for a technique for launching a missile that avoids or mitigates some or all of these problems.

SUMMARY OF THE INVENTION

The present invention provides a technique for launching a missile that avoids some of the costs and disadvantages for doing so in the prior art. In particular, the illustrative embodiment of the present invention uses an electromagnetic catapult to throw the missile clear of the launch platform—with sufficient velocity to attain aerodynamic flight—before the missile's engine is ignited. This mitigates some of the problems associated with launching missiles in the prior art.

The illustrative embodiment comprises: a missile; a sled; a guide for substantially constraining the motion of the sled to a line; a first coil that is substantially immovable with respect to the guide; and a second coil that is substantially immovable with respect to the sled; wherein the flow of electric current in the first coil and the second coil induces the sled to move with respect to the guide and to throw the missile.

DETAILED DESCRIPTION

Figure 1:
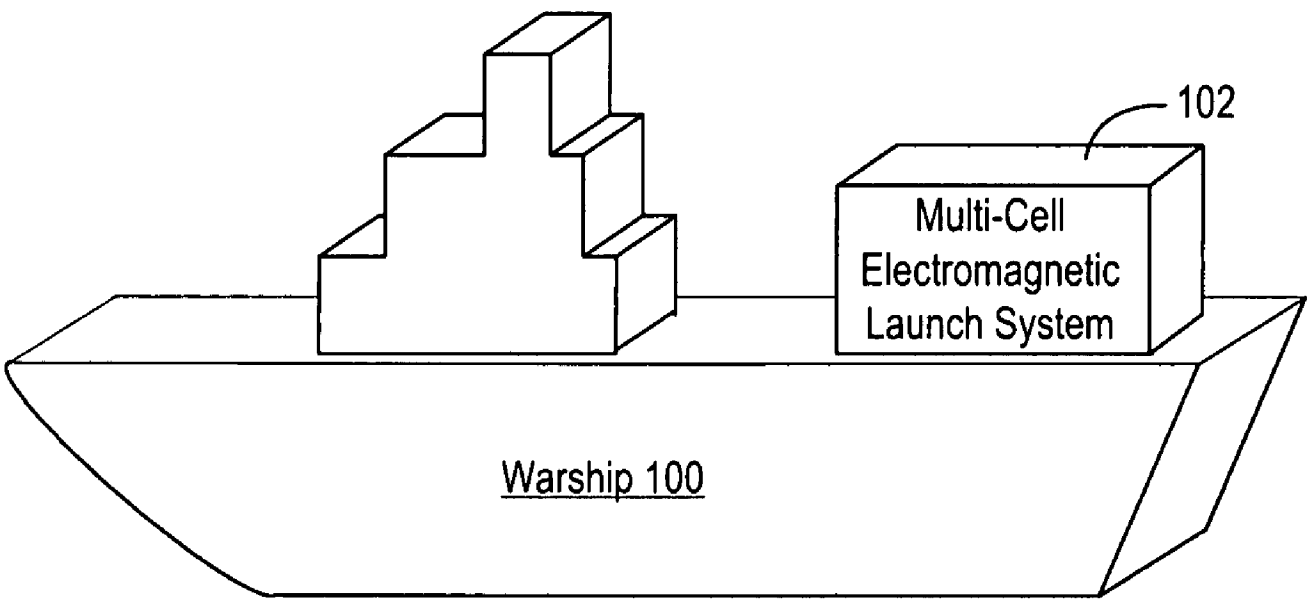
FIG. 1 depicts a representational diagram of a ship-borne multi-cell electromagnetic launch system in accordance with the illustrative embodiment.

FIG. 1 depicts a representational diagram of a naval launch system in accordance with the illustrative embodiment. Although launch system 102 is mounted on the deck of a warship, it will be clear to those skilled in the art, after reading this disclosure, how to make and use alternative embodiments of the present invention in which launch system 102 is terrestrially-based or is mounted on another type of vehicle (e.g., a truck, a railroad car, a submarine, a space vehicle, a satellite, etc.)

Figure 2:
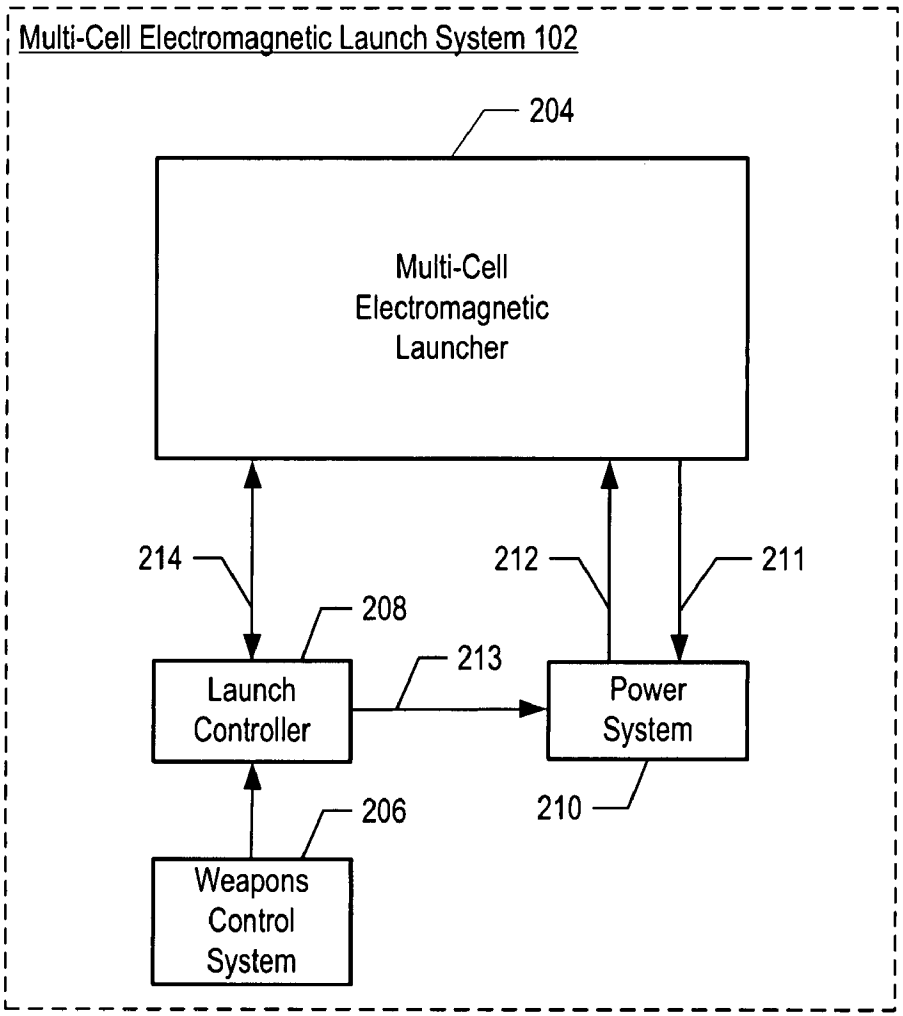
FIG. 2 depicts a schematic diagram of multi-cell electromagnetic launch system 102.

FIG. 2 depicts a schematic diagram of the salient components of launch system 102. Launch system 102 comprises multi-cell electro-magnetic launcher 204, weapons control system 206, launch controller 208, power system 210, return power bus 211, propulsion current bus 212, signal line 213, and data bus 214.

Launcher 204 is a system that has the capability to house and expel one or more missiles upon command. The system expels each missile from its cell using an electromagnetic catapult and without the aid of the missile's chemical-propulsion engines. This is advantageous because it enables the missile to clear the launch platform before it ignites its engine, which mitigates the deleterious effects of the engine's ignition near the launch platform.

Weapons control system 206 provides targeting and flight information and firing authority to launch controller 208 prior to and during a launch sequence. It will be clear to those skilled in the art, after reading this disclosure, how to make and use weapons control system 206.

Launch controller 208 provides the targeting and flight information to a missile prior to launch and the directive to launch to power system 210.

Power system 210 comprises circuitry that conditions and manages the storage and delivery of power to, and the recover of power from, launcher 204 in response to signals from launch controller 208. Power system 210 controls power generation, scavenging, storage, and delivery prior to, during, and after each launch. Power system 210 is described in detail below and with respect to FIG. 3.

Propulsion current bus 212 carries power from power system 210 to each launch cell within launcher 204. Return power bus 211 carries scavenged power from each launch cell within launcher 204 to power system 210.

Signal line 213 connects launch controller 208 to power system 210 and carries the commands that direct power system 210 to initiate and control the launch of a missile. Data bus 214 carries the targeting information from launch controller 208 to the missiles and sled position information from sled-position sensor 560 (shown in FIG. 5) to launch controller 208.

Figure 3:
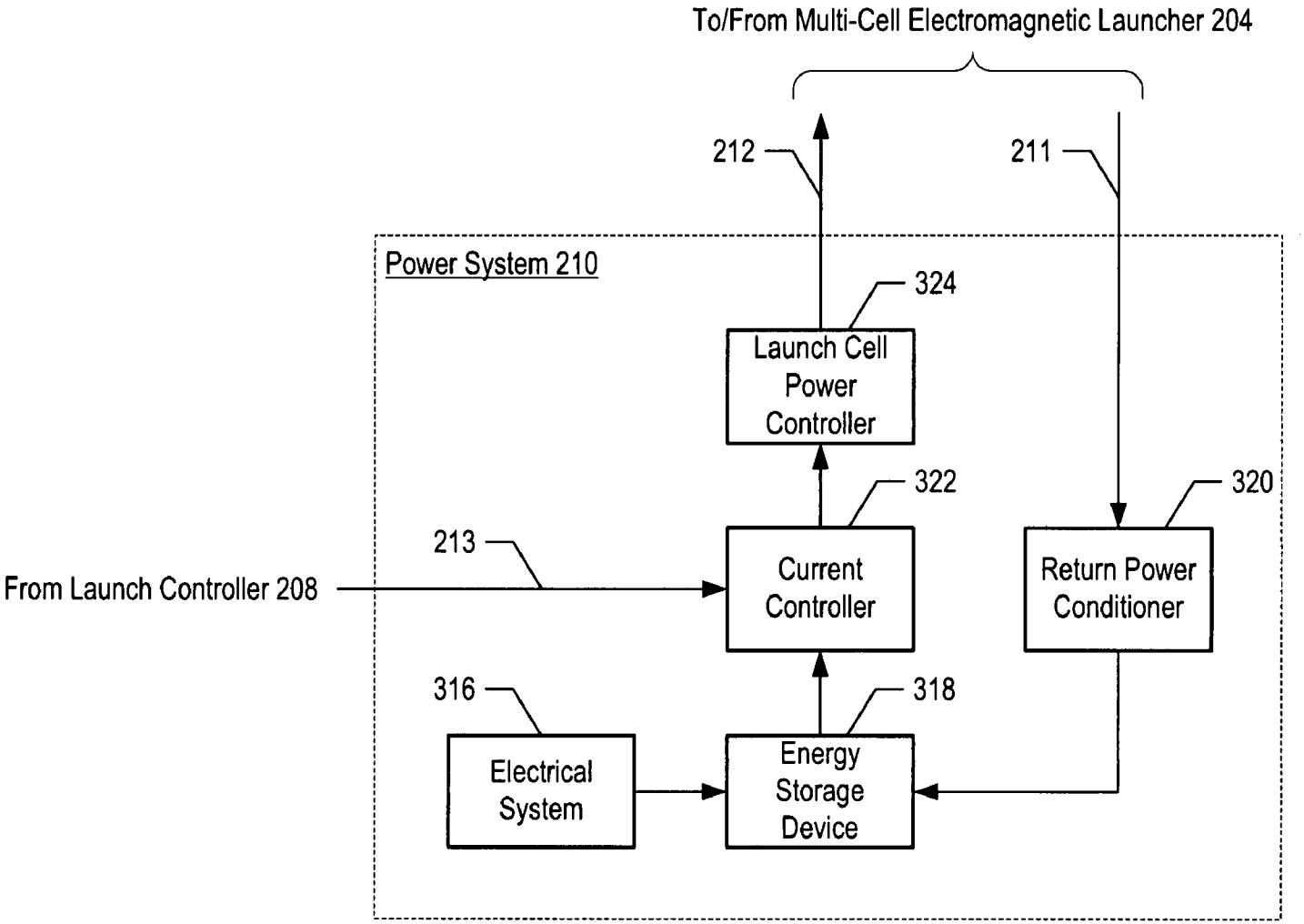
FIG. 3 depicts a schematic diagram of power system 210 in accordance with the illustrative embodiment.

FIG. 3 depicts a schematic diagram of the salient components of power system 210 in accordance with the illustrative embodiment. Power system 210 comprises electrical system 316, energy storage device 318, current controller 322, launch cell power controller 324, and return power conditioner 320.

Launch cell power controller 324 comprises circuitry for delivering electricity to the appropriate launch cell of launcher 204 under the direction of current controller 322.

Current controller 322 comprises circuitry for conditioning and controlling delivery of electric current from energy storage device 318 to launch cell power controller 324. In response to firing signals from launch controller 208, delivered on signal line 213, current controller 322, together with launch cell power controller 324, delivers electric current to the launch cells of launcher 204 on propulsion current bus 212.

Energy storage device 318 is an electrical capacitor system that is capable of transferring high voltage/amperage electrical current to the launch cells of launcher 204. It will be clear to those skilled in the art how to make and use energy storage device 318. Although energy storage device 318 is an electrical capacitor system, it will be clear to those skilled in the art, after reading this disclosure, how to make and use alternative embodiments of the present invention in which energy storage device 318 is a rotational mass power storage system, or any other power storage system capable of transferring high voltage/amperage electrical current.

Electrical system 316 comprises an electrical generator and power conditioning circuitry that charges energy storage device 318 in well-known fashion to supply electricity to launcher 204. It will be clear to those skilled in the art how to make and use electrical system 316.

Return power conditioner 320 comprises electrical circuitry, in well-known fashion, that recharges energy storage device 318 with the electrical energy on return power bus 211.

In general, current controller 322 and energy storage device 318 deliver electrical energy to launch cell power controller 324, upon receipt of a firing command from launch controller 208, via signal line 213. Launch cell power controller 324 then delivers the electrical energy to the appropriate cell of launcher 204 via propulsion current bus 212. Return power bus 211 carries energy scavenged during a launch (as will be described below in detail and with regard to FIGS. 5 through 8) to return power conditioner 320, which conditions the energy and delivers it to energy storage device 318.

Figure 4:
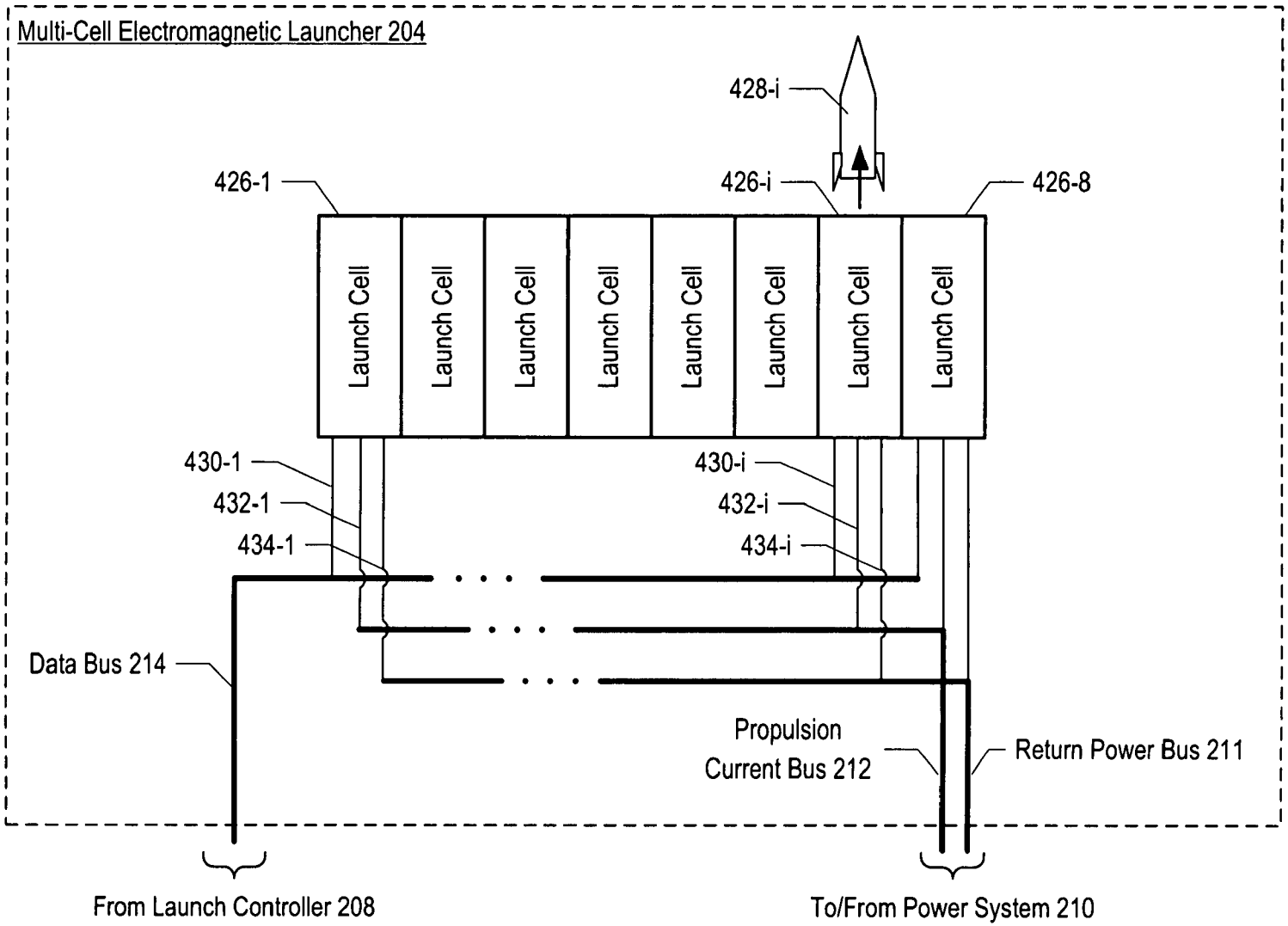
FIG. 4 depicts a representational diagram of multi-cell electromagnetic launcher 204 in accordance with the illustrative embodiment.

FIG. 4 depicts a representational diagram of launcher 204 in accordance with the illustrative embodiment. Launcher 204 comprises eight (8) launch cells 426-1 through 426-8, data bus 214, propulsion current bus 212, return power bus 211, and missile 428-i wherein i is a positive integer in the set $\{1, \ldots 8\}$.

Data bus 214 comprises eight (8) data lines 430-1 through 430-8, and each of the data lines feeds one of the launch cells. Propulsion current bus 212 comprises eight (8) propulsion current lines 432-1 through 432-8, and each of the data lines feeds one of the launch cells. Return power bus 211 comprises eight (8) return power lines 434-1 through 434-8, and each of the data lines feeds one of the launch cells. Although the illustrative embodiment comprises 8 launch cells, it will be clear to those skilled in the art, after reading this disclosure, how to make and use embodiments of the present invention that comprise any number of launch cells.

Figure 5:
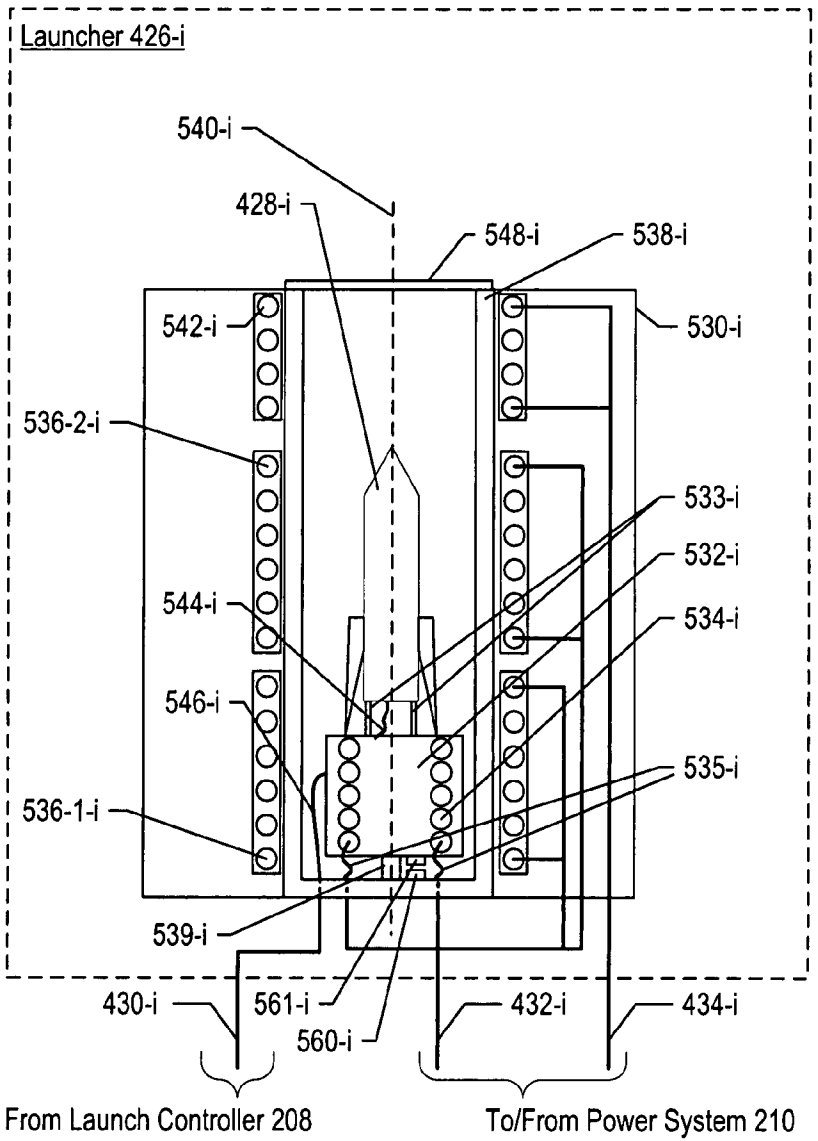
FIG. 5 depicts a cross-sectional view of launch cell 426-i at the beginning of a representative launch sequence (as described with respect to FIG. 10), in accordance with the illustrative embodiment.

FIG. 5 depicts a cross-sectional view of launch cell 426-i at the beginning of a representative launch sequence (as described with respect to FIG. 10), in accordance with the illustrative embodiment. Launch cell 426-i comprises: canister 530-i, missile 428-i, sled 532-i, sled restraint bolt 539, missile restraint bolts 533-i, sled coil 534-i, canister to sled current conductors 535-i, guide 538-i, first coil 536-1-i, second coil 536-2-i, third coil 542-i, canister-to-sled umbilical 546-i, sled-to-missile umbilical 544-i, and fly-through cover 548-i, sled-position sensor 560-i, and reflector 561-i. Each launch cell in launcher 204 is identical and operates independently of the other launch cells.

Canister 530-i, together with fly-through cover 548-i, encloses sled 532-i, sled restraint bolt 539, missile restraint bolts 533-i, sled coil 534-i, missile 428-i, guide 538-i, canister to sled umbilical 546-i, sled to weapon umbilical 544-i, first coil 536-1-i, second coil 536-2-i, and third coil 542-i to provide a substantially air-tight environment, in well-known fashion.

Missile 428-i comprises an explosive warhead, a chemical-propellant engine, and an accelerometer. Missile 428-i is described in detail below and with respect to FIG. 9B. It will be clear to those skilled in the art, after reading this disclosure, how to make and use missile 428-i.

Sled 532-i comprises a rigid platform of suitable size for holding missile 428-i, and comprises bearings 954-i. Prior to a launch, sled 532-i is rigidly attached to canister 530-i by sled restraint bolt 539, and missile 428-i is attached to sled 532-iby missile restraint bolts 533-i.

Sled restraint bolt 539 is commonly and colloquially called a "dog bone." Sled restraint bolt 539 is designed to break when subjected to a tensile force above a specific and predetermine threshold. It will be clear to those skilled in the art, after reading this disclosure, how to make and use sled restraint bolt 539.

Missile restraint bolts 533-i are actuatable (e.g., explosive, electromagnetic, etc.) in order to proactively unfasten missile 428-i from sled 532-i at the proper instant. It will be clear to those skilled in the art, after reading this disclosure, how to make and use missile restraint bolts 533-i.

Figure 7:
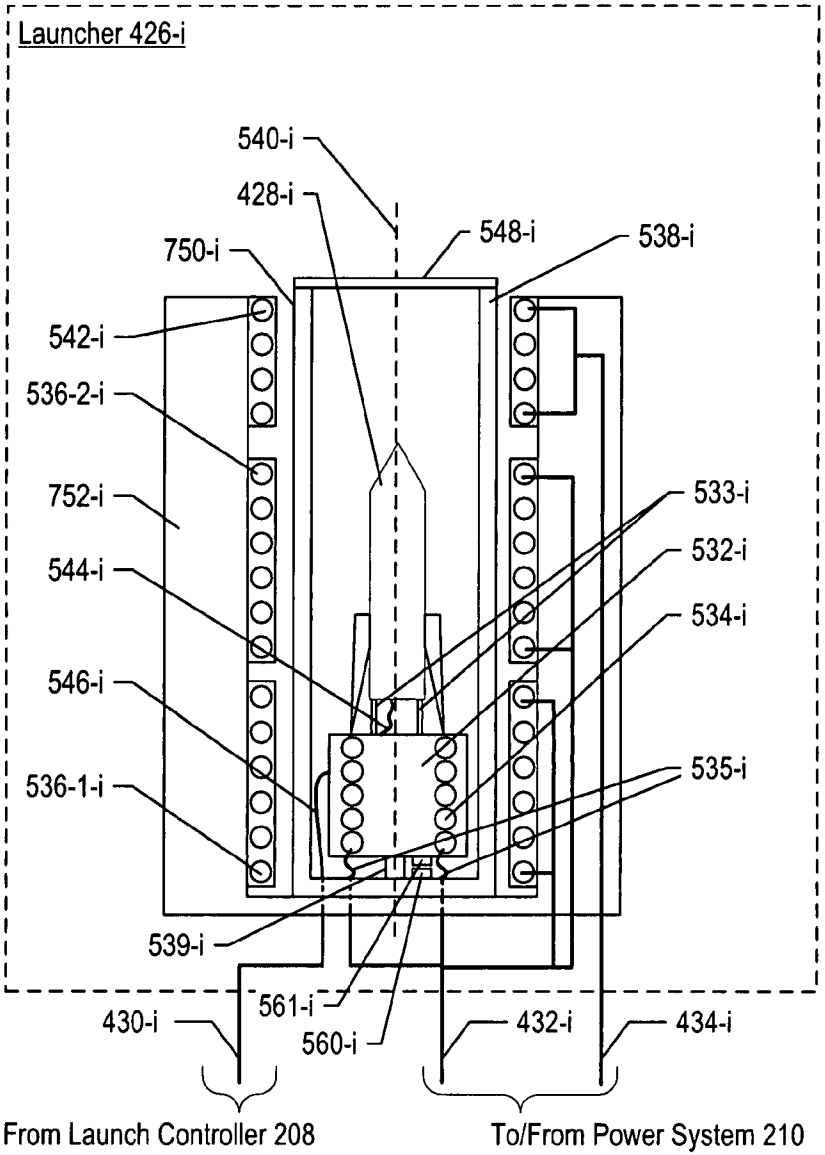
FIG. 7 depicts an alternative embodiment of the present invention prior to a launch a representative launch sequence (such as that described with respect to FIG. 10), respectively.
Figure 8:
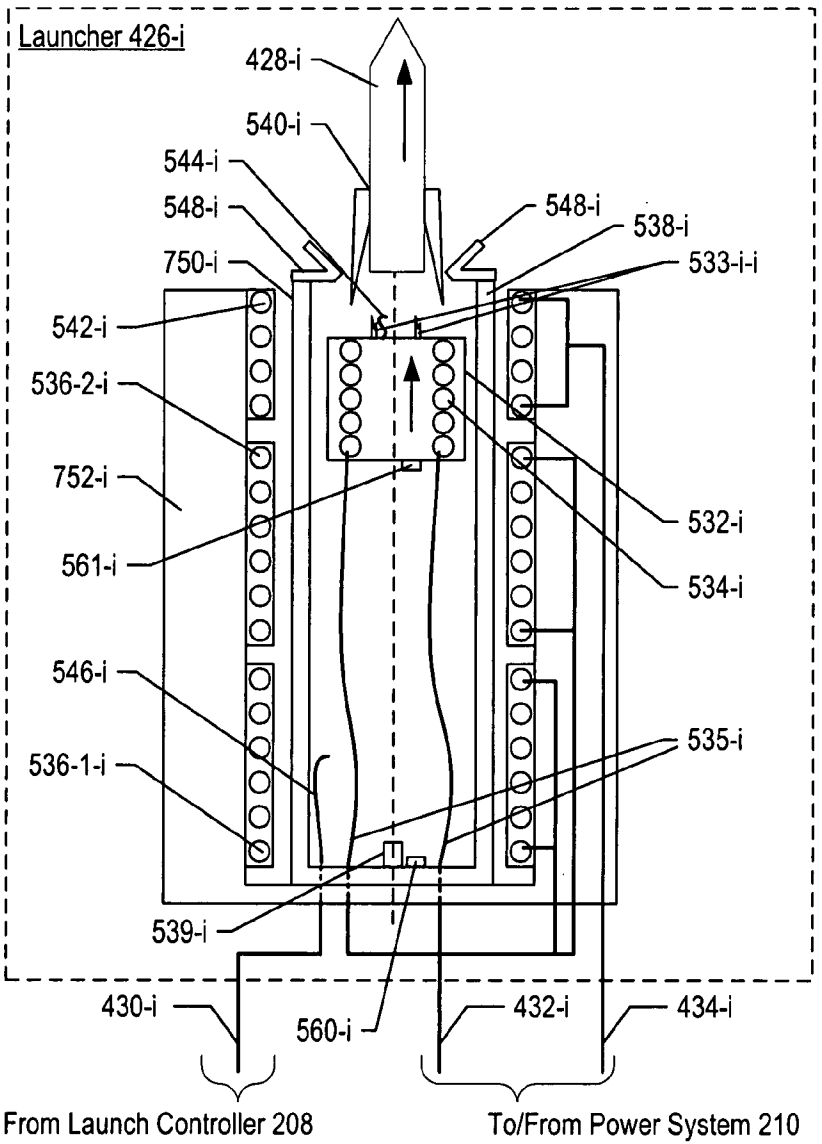
FIG. 8 depict an alternative embodiment of the present invention at the end of a representative launch sequence (such as that described with respect to FIG. 10), respectively.
Figure 9B:
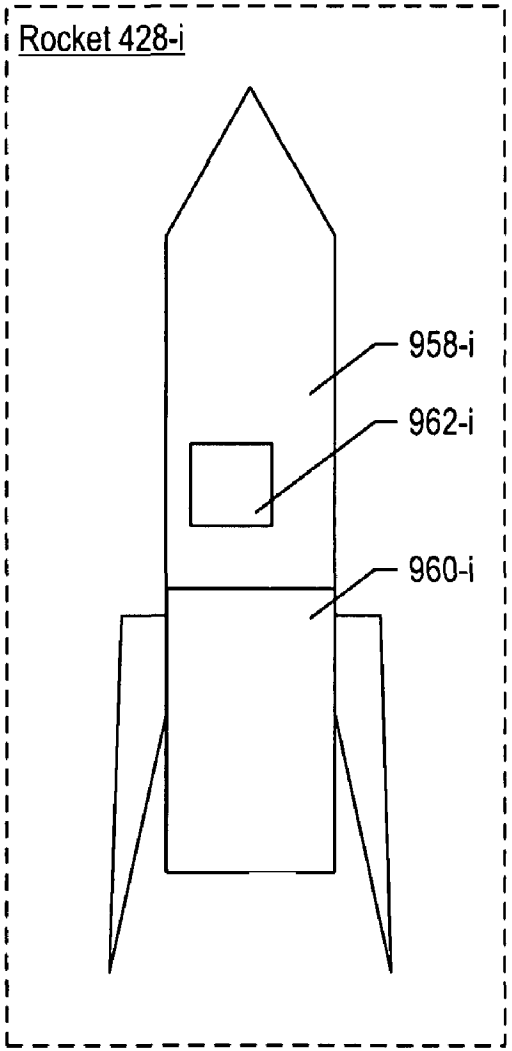
FIG. 9B depicts a cross-sectional view of missile 428-i in accordance with the illustrative embodiment of the current invention.
Figure 9A:
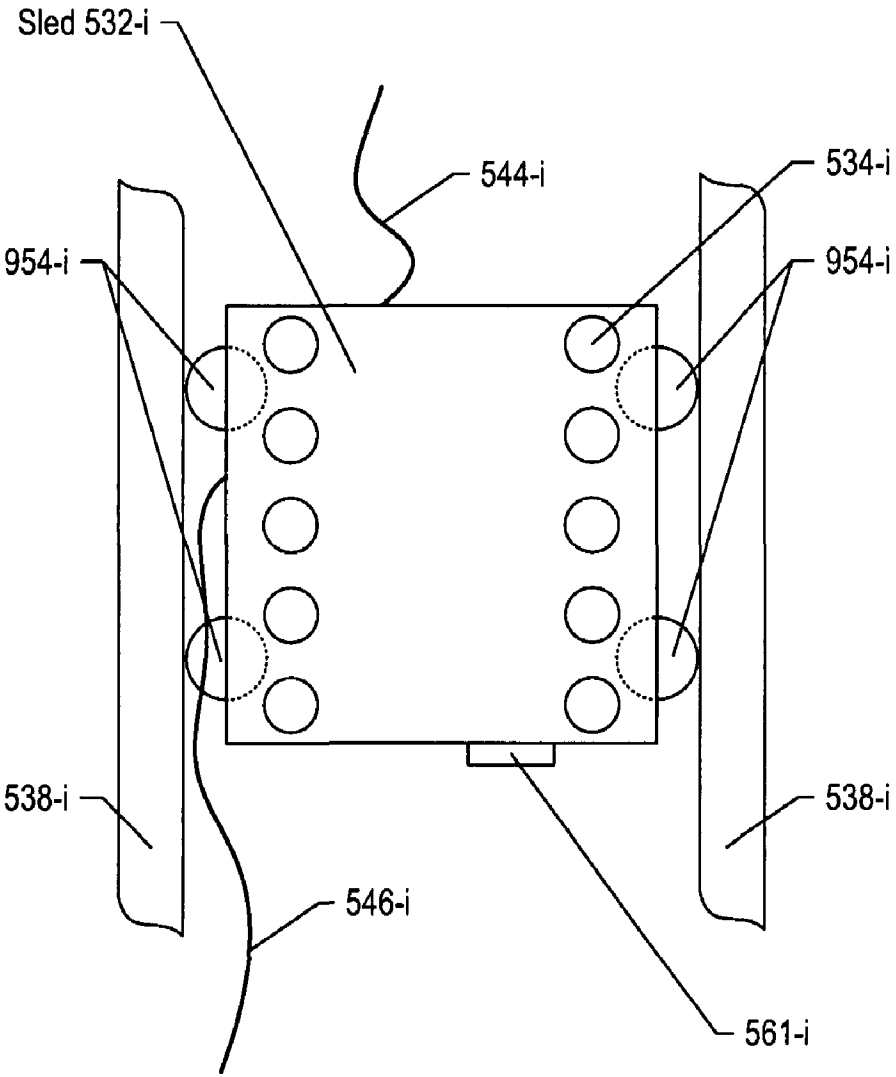
FIG. 9A depicts a cross-sectional view of sled 532-i in accordance with the illustrative embodiment of the current invention.

Bearings 954-i and position sensor 561-i (which are depicted in FIG. 9A) are also enclosed by canister 530-i but are omitted from FIGS. 5 through 8 for clarity. Sled 532-i holds sled coil 534-i such that sled coil 534-i has a helical shape and is substantially immovable with respect to sled 532-i. Sled 532-i is described in detail below and with respect to FIG. 9A. It will be clear to those skilled in the art, after reading this disclosure, how to make and use sled 532-i.

Sled coil 534-i comprises a helical coil of electrical conductor, capable of carrying sufficiently high voltage/amperage to enable sufficient launch power, and sled coil 534-i is substantially immovable with respect to sled 532-i. Sled coil 534-i generates an electromagnetic force along axis 540-i when energized with electric current. The direction of electromagnetic force generated by sled coil 534-i along axis 540-i depends on the direction of current flow in sled coil 534-i.

Canister-to-sled current conductors 535-i comprise electrical conductors of sufficient length to span the length of travel of sled 532-i during a launch. Canister-to-sled current conductors 535-i provide electrical connection of sled 532-i to power system 210 throughout the entire launch.

Guide 538-i comprises four vertical members that provide structural support for canister 530-i and first coil 536-1-i, second coil 536-2-i, and third coil 542-i which are affixed to guide 538-i in a substantially-immovable manner. Guide 538-i also provides straight, smooth tracks against which bearings 954-i ride during a launch. Although the illustrative embodiment comprises four (4) vertical structural members, it will be clear to those in skilled in the art, after reading this disclosure, how to make and use embodiments of the present invention that comprise any number of vertical structural members.

First coil 536-1-i and second coil 536-2-i each comprise a helix of electrical conductor, wherein each helix has an inner diameter larger than the outer diameter of sled coil 534-i, and wherein the electrical conductor is capable of carrying sufficiently high voltage/amperage to enable sufficient launch power. First coil 536-1-i and second coil 536-2-i each generate electromagnetic force along axis 540-i when energized with electric current. The direction of electromagnetic force generated along axis 540-i by each of first coil 536-1-i and second coil 536-2-i depends on the direction of current flow in that coil. It will be clear to those skilled in the art, after reading this disclosure, how to make and use first coil 536-1-i and second coil 536-2-i.

Third coil 542-i comprises a helix of electrical conductor, wherein the helix has an inner diameter larger than the outer diameter of sled coil 534-i and third coil 542-i is substantially immovable with respect to guide 538-i. During a launch, third coil 542-i is used to recover some of the kinetic energy of moving sled 532-i as electric current and return the recovered power to energy storage device 318 through return power bus 211 and return power conditioner 320 as is described in detail below and with respect to FIG. 6. It will be clear to those skilled in the art, after reading this disclosure, how to make and use third coil 542-i.

Sled-position sensor 560-i is an optical range-finding device on the bottom of canister 530-i. Sled-position sensor 560-i transmits an optical beam at reflector 561-i, which is located on the bottom of sled 532-i, and determines the position of sled 532-i based on the time-of-travel of the reflected beam. The position of sled 532-i is used by launch controller 208 to sequence current flow in first coil 536-1-i and second coil 536-2-i. It will be clear to those skilled in the art, after reading this disclosure, how to make and use sled-position sensor 560-i and reflector 561-i.

Prior to the launch, targeting information is passed from launch controller 208 to missile 428-i via canister to sled umbilical 546-i and sled to missile umbilical 544-i. Canister-to-sled current conductors 535-i connect power system 210 to sled 532-i throughout a launch.

During the representative launch sequence, sled coil 534-i and first coil 536-1-i are energized with current supplied by power system 210-i on propulsion current line 432-i. Launch cell power controller 324-i controls the flow of electric current in sled coil 534-i, which is substantially immovable with respect to sled 532-i. Launch cell power controller 324-i also controls the flow of electric current in first coil 536-1-i and second coil 536-2. The current flow is controlled such that a first electromagnetic force is generated along axis 540-i by sled coil 534-i, and a second electromagnetic force is generated along axis 540 by first coil 536-1-i. The direction of the forces is made so as to cause a propulsion force on sled 532-i that is directed upward along axis 540-i. When the magnitude of the propulsion force exceeds a pre-determined threshold, sled restraint bolt 539 releases, and sled 532-i is allowed to travel upward along axis 540-i.

As sled 532-i travels along axis 540-i, launch cell power controller 324 sequences the flow of current in first coil 536-1-i and second coil 536-2-i in order to substantially maximize propulsion of sled 532-i. The illustrative embodiment comprises two propulsion coils, first coil 536-1-i and a second coil 536-1-i. It will be clear to those skilled in the art, however, after reading this specification, how to make and use alternative embodiments of the present invention that comprise any number of coils that are:

i. continuous; or ii. separate and on any suitable spacing; or iii. inter-leaved along the length of guide 538-i; or iv. any combination of i, ii, and iii.

Figure 6:
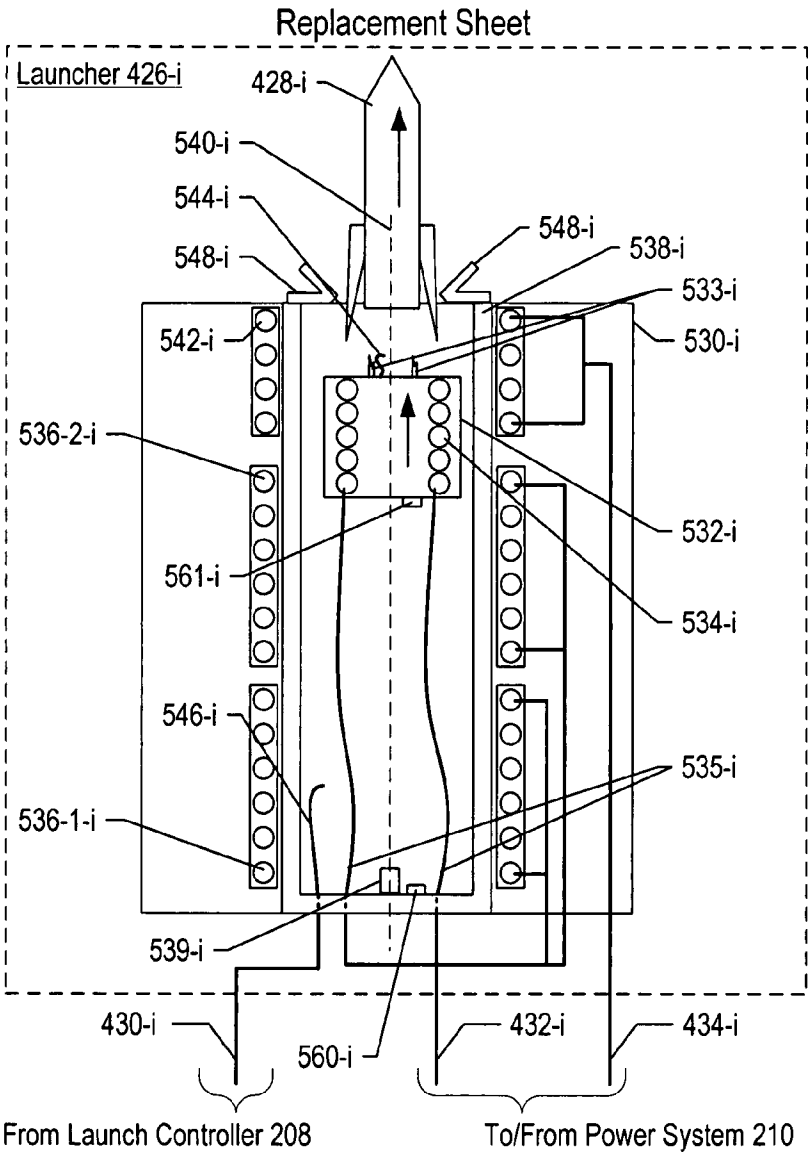
FIG. 6 depicts a cross-sectional view of the same electromagnetic launch cell 426-i depicted in FIG. 5, but wherein sled 532-i is shown near the end of its travel at the end of the representative launch sequence.

FIG. 6 depicts a cross-sectional view of the same electromagnetic launch cell 426-i depicted in FIG. 5, but wherein sled 532-i is shown near the end of its travel at the end of the representative launch sequence. Near the end of the representative launch sequence, missile 428-i passes through fly-through cover 548-i and sled-to-missile umbilical 544-i detaches from missile 428-i. Missile 428-i is thrown from sled 532-i (i.e., separation occurs) with velocity sufficient to achieve aerodynamic stability.

As sled 532-i approaches the end of its travel along axis 540-i, power system 210 institutes a change in current flow in sled coil 534-i, first coil 536-1-i, and second coil 536-2-i to generate attractive electromagnetic force along axis 540-i between sled coil 534-i, first coil 536-1-i, and second coil 536-2-i to decelerate and stop sled 532-i. Just prior to deceleration, missile restraint bolts 533-i are actuated and missile 428-i is released from sled 532-i and missile 428-i continues to exit the canister. Current flow is maintained in sled coil 534-i as sled 532-i decelerates and passes through third coil 542-i. The sled's kinetic energy is absorbed by third coil 542-i and returned to energy storage device 318 via return power current bus 211 and return power conditioner 320. The energy scavenging process is analogous to the generation of electric power by rotor coils passing by fixed permanent magnets in a conventional electric generator.

FIGS. 7 and 8 depict an alternative embodiment of the present invention at times prior to a launch and at the end of a representative launch sequence (such as that described with respect to FIG. 10), respectively. Referring to FIG. 7, launch cell 426-i comprises: canister 750-i, missile 428-i, sled 532-i, missile restraint bolts 533-i, sled coil 534-i, canister to sled current conductors 535-i, guide 538-i, first coil 536-1-i, second coil 536-2-i, third coil 542-i, canister-to-sled umbilical 546-i, sled-to-missile umbilical 544-i, fly-through cover 548-i, and launch structure 752-i. Each launch cell in launcher 204 is identical and operates independently of the other launch cells.

Canister 750-i, together with fly-through cover 548-i, encloses sled 532-i, sled coil 534-i, missile 428-i, missile restraint bolts 533-i, guide 538-i, canister to sled umbilical 546-i, and sled to weapon umbilical 544-i to provide a substantially air-tight environment, in well-known fashion.

In the alternative embodiment depicted in FIGS. 7 and 8, first coil 536-1, second coil 536-2, and third coil 542, are substantially immovable with respect to launch structure 752-i and are located outside canister 750 (as opposed to within canister 530 in the illustrative embodiment). In order to facilitate the generation of sufficient force between the electromagnets comprising sled coil 534 and each of first coil 536-1 and second coil 536-2, the walls of canister 750 are thin and constructed of a non-magnetic material. Suitable materials for use in canister walls include polymers, aluminum, ceramics, titanium, and some non-magnetic stainless steels.

FIG. 9A depicts a cross-sectional view of sled 532-i in accordance with the illustrative embodiment of the current invention. Sled 532-i comprises sled coil 534-i, and bearings 954-i, reflector 561-i, and sled-to-missile umbilical 544-i.

Each of bearings 954-i comprises rollers that enable smooth travel of sled 532-i along guide 538-i. It will be clear to those skilled in the art, after reading this disclosure, how to make and use alternative embodiments of the current invention in which bearings 954-i comprise ball bearings, roller bearings, Teflon-coated glide plates, or lubricated glide plates.

FIG. 9B depicts a cross-sectional view of missile 428-i in accordance with the illustrative embodiment of the current invention. Missile 428-i comprises warhead 958-i, chemical-propulsion engine 960-i, and accelerometer 962-i.

Accelerometer 962-i provides a signal that is used to (i) blow bolts 533-i and (ii) initiate ignition of chemical-propellant engine 960-i. Bolts 533-i are blown at the instant that sled 532-i and missile 428-i begin to decelerate (i.e., are at the maximum velocity), and chemical-propellant engine 960-i is ignited once missile 428-i has achieved sufficient clearance from multi-cell electromagnetic launcher 102 but before missile 428-i has lost aerodynamic stability. It will be clear to those skilled in the art, after reading this disclosure, how to make and use accelerometer 962-i. Furthermore, it will be clear to those skilled in the art, after reading this specification, how to make and use alternative embodiments of the present invention that use other means of initiating ignition of chemical-propellant engine 960-i such as a signal from an altimeter, a timing circuit, a fuse, or signal transmitted to missile 428-i from weapons control system 206.

Figure 10:
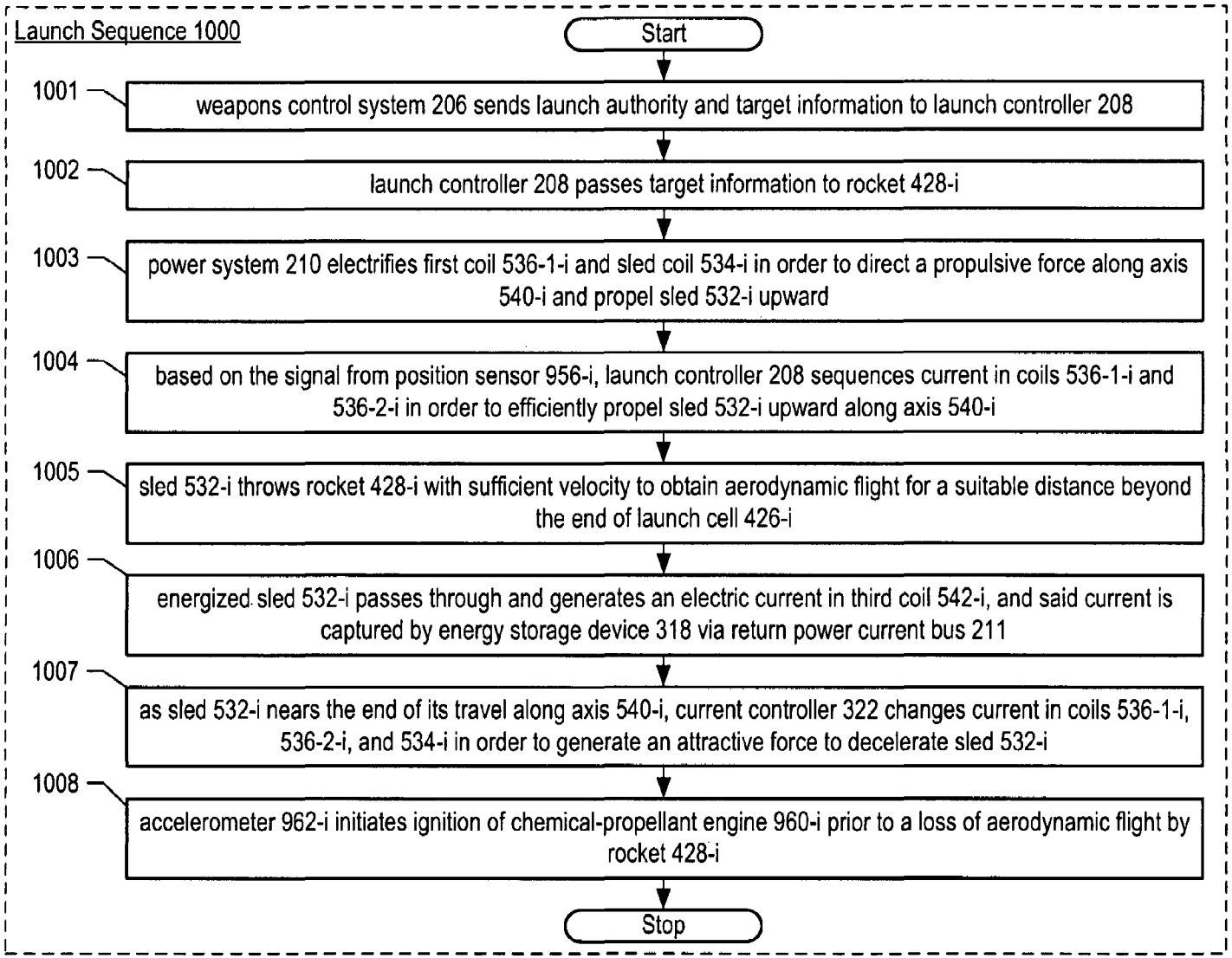
FIG. 10 depicts a representative launch sequence according to the illustrative embodiment.

FIG. 10 depicts a flowchart of the salient tasks associated with a representative launch sequence, in accordance with the illustrative embodiment. Launch sequence 1000 comprises:

At task 1001, weapons control system 206 passes launch authority and targeting information to launch controller 208;

At task 1002, launch controller 208 passes target information to missile 428-i;

At task 1003, launch cell power controller 324 electrifies first coil 536-1-i and sled coil 534-i in order to generate a propulsive force on sled 532-i in order to propel sled 532-i upward along axis 540-i;

At task 1004, launch cell power controller 324 sequences the current in first coil 536-1-i and second coil 536-2-i in order to substantially maximize propulsion of sled 532-i;

At task 1005, bolts 533-i are blown and missile 428-i is thrown from sled 532-i;

At task 1006, third coil 542-i captures the kinetic energy associated with moving, energized sled 532-i;

At task 1007, current controller 322 changes the current in sled coil 534-i and first and second coils 536-1-i and 536-2-i in order to change the generated force on sled 532-i from propulsive to attractive; and At task 1008, the ignition of chemical-propellant engine 960-i is initiated after missile 428-i has achieved sufficient distance from multi-cell electromagnetic launch system 102.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising:

a missile;

a sled;

a guide for substantially constraining the motion of said sled to a line;

a first coil that is substantially immovable with respect to said guide, wherein said first coil is substantially concentric about said line; and a second coil that is substantially immovable with respect to said sled, wherein said second coil is substantially concentric about said line, and wherein said first coil and said second coil are not electrically connected;

wherein a flow of a first electric current in said first coil and a flow of a second electric current in said second coil mutually induce said sled to move with respect to said guide and to throw said missile.

2. The apparatus of claim 1 wherein said missile comprises a chemical-propulsion engine.

3. The apparatus of claim 2 further comprising a canister, wherein said canister encloses said sled and said missile, and wherein said canister is sealed to be substantially air-tight.

4. The apparatus of claim 2 further comprising an accelerometer that generates a signal that initiates the ignition of said chemical-propulsion engine.

5. The apparatus of claim 1 further comprising a third coil that is substantially immovable with respect to said guide.

6. The apparatus of claim 5 further comprising a current controller for sequencing said first flow of electric current through said first coil and a third flow of electric current through said third coil to move said sled.

7. The apparatus of claim 5 further comprising an energy-storage device for storing the energy in an electric current that is induced in said third coil by the motion of said sled.

8. The apparatus of claim 5 further comprising:

a position sensor for sensing the position of said sled with respect to said guide; and a current controller for sequencing said first flow of current through said first coil and a third flow of electric current through said third coil based on the output of said position sensor.

9. The apparatus of claim 1 further comprising an umbilical for enabling communication between said sled and said missile.

10. An apparatus comprising:

a missile that comprises a chemical-propulsion engine;

a sled for throwing said missile, wherein said sled comprises a first electro-magnet that comprises a first physical adaptation that enables said first electro-magnet to carry a first electric current; and a guide for propelling said sled, wherein said guide comprises a second electro-magnet that comprises a second physical adaptation that enables said second electro-magnet to carry a second electric current;

wherein said first electro-magnet and said second electro-magnet are substantially coaxial and not electrically connected; and wherein an interaction of said first electro-magnet and said second electro-magnet together propel said sled.

11. The apparatus of claim 10 further comprising a canister, wherein said canister encloses said sled and said missile, and wherein said canister is sealed to be substantially airtight.

12. The apparatus of claim 10 further comprising an accelerometer that generates a signal that initiates the ignition of said chemical-propulsion engine.

13. The apparatus of claim 10 wherein said guide further comprises a third electro-magnet.

14. The apparatus of claim 13 further comprising a current controller for sequencing the flow of current in said second electro-magnet and said third electro-magnet to move said sled.

15. The apparatus of claim 10 wherein said guide further comprises a capture coil.

16. The apparatus of claim 15 further comprising an energy storage device for storing the energy in an electric current that is induced in said capture coil by the motion of said sled.

17. The apparatus of claim 10 further comprising an umbilical, wherein said umbilical enables communication between said sled and said missile.

18. The apparatus of claim 10 further comprising a position sensor, wherein said position sensor senses the position of said sled with respect to said guide.

* * * * *